United States Patent [19]

Wylie et al.

[11] Patent Number: 4,465,291

[45] Date of Patent: Aug. 14, 1984

[54] BOAT LAUNCHING DOLLY

[76] Inventors: Earvin T. Wylie; Ruth E. Wylie, both of 4644 Calle de Casitas, Oceanside, Calif. 92056

[21] Appl. No.: 422,033

[22] Filed: Sep. 23, 1982

[51] Int. Cl.[3] ..... B62B 1/12

[52] U.S. Cl. ..... 280/47.13 B; 280/47.24

[58] Field of Search ..... 280/414.2, 47.13 B, 280/47.24, 79.1 A; 114/344

[56] References Cited

U.S. PATENT DOCUMENTS

| | | | |
|---|---|---|---|
| 2,540,279 | 2/1951 | Mosier | 280/414.2 |
| 2,863,159 | 12/1958 | Bear | 114/344 |
| 2,978,257 | 4/1961 | Barker | 280/414.2 |
| 3,090,973 | 5/1963 | Levinson | 114/344 |
| 3,567,241 | 3/1971 | Foschino | 280/414.2 |
| 4,059,282 | 11/1977 | Prickett | 280/414.2 |
| 4,300,252 | 11/1981 | Montooth | 280/414.2 |

*Primary Examiner*—Joseph F. Peters, Jr.
*Assistant Examiner*—D. Lynn Fugate
*Attorney, Agent, or Firm*—Brown & Martin

[57] ABSTRACT

A boat launching dolly includes a horizontal support frame having spaced apart steerable wheels with a V-shape adjustable height cradle for engaging the bottom of a boat adjacent the bow for supporting the front of a boat and including a forwardly upwardly curved central elongated frame member extending forwardly and upwardly to connect to a prow eye.

8 Claims, 3 Drawing Figures

BOAT LAUNCHING DOLLY

BACKGROUND OF THE INVENTION

The present invention relates to dollies and pertains particularly to a steerable bow dolly for a boat.

Many boats are sufficiently small and light that they are traditionally transported on a car top eliminating the necessity for trailers. Such boats while small and light are still rather difficult to easily launch by hand. For this reason, numerous dollies have been proposed for facilitating the launching of such boats.

Exemplary of the prior art approach to boat launching dollies are the following patents:

U.S. Pat. No. 2,540,279 issued Feb. 6, 1951 to Mosier.

U.S. Pat. No. 2,978,257 issued Apr. 4, 1961 to Barker.

U.S. Pat. No. 3,567,241 issued Mar. 2, 1971 to Foschino.

U.S. Pat. No. 4,059,282 issued Nov. 22, 1977 to Prickett.

U.S. Pat. No. 4,300,252 issued Nov. 17, 1981 to Montooth.

The Foschino patent is of interest in that it discloses a detachable boat wheeling device detachably mountable on the front or bow of a boat. The device, however, has a single wheel requiring steering by swinging the stern of the boat about and also requires attachment cables including hooks 15 and 16 which are adapted to hook over the gun wale portions at each side of the boat for securement of the wheeling device to the boat.

The Montooth patent is of particular interest in that it discloses the use of a front wheel support dolly in combination with a rear wheel support dolly. The front dolly, however, is permanently secured to the boat and is retractable from its supporting position and also provides a towing hitch or coupling for towing the boat behind a car. The front dolly is incapable of steering as is the applicant's.

The remaining patents above referenced are of interest only as showing the general state of the art.

These devices fail to provide the convenience of a truly quickly detachable, and yet stable, dolly for the launching of small boats. Moreover, they do not provide a truly convenient dolly that is usable in combination with a stern mounted dolly to truly enhance the ability to handle and launch small boats.

It is therefore desirable that an improved easily detachable steerable and stable dolly be available for the launching of small boats.

SUMMARY AND OBJECTS OF THE INVENTION

It is therefore the primary object of the present invention to provide an improved dolly for the launching of small boats.

In accordance with the primary aspect of the present invention, a dolly for the launching of small boats includes a support frame having laterally spaced steerable support wheels and a forwardly extending central frame member extending forward and securable to the prow eye of a small boat for quick attachment and detachment and for providing total stable support of a boat.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
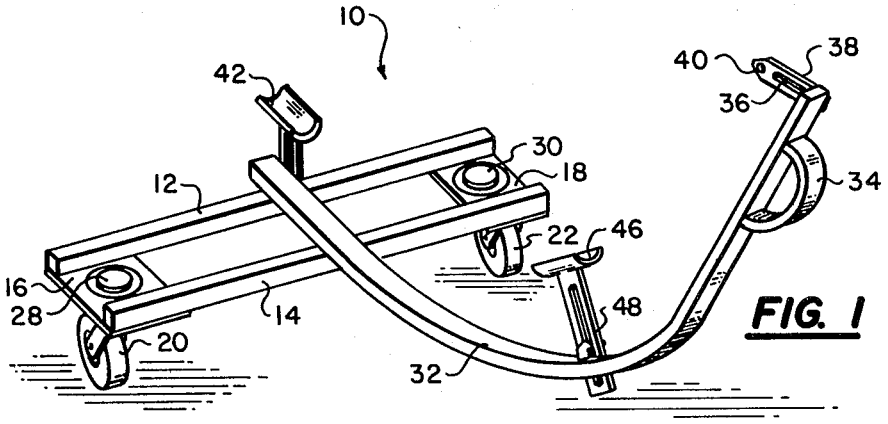
FIG. 1 is a perspective view of a dolly in accordance with the invention.
Figure 3:
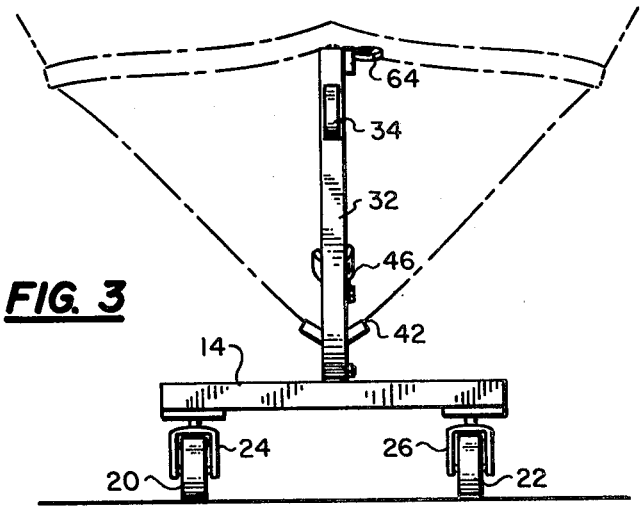
FIG. 3 is a front elevation view of the dolly of FIG. 1 showing a boat in phantom positioned on the dolly.

Referring to FIG. 1, a boat launching dolly designated generally by the numeral 10, includes a main horizontal support frame comprising a pair of generally parallel frame members 12 and 14 secured at opposite ends to support plates 16 and 18 of a pair of steerable dollies. The support frame members 12 and 14 can be any suitable configuration but are illustrated as rectangular and preferably are relatively high strength tubular members for strength and weight. The generally rectangular plates 16 and 18 secure the frame members 12 and 14 together and form the support plates for a pair of identical steerable caster wheels 20 and 22. The wheels 20 and 22 are rotatably mounted by means of forks 24 and 26 each respectively having a vertically extending shank supported in bearing assemblies 28 and 30 at the center of the support or mounting plates 16 and 18.

A forwardly extending central frame member 32 is secured at an inner end to the frame members 12 and 14 such as by welding, bolting, or the like and extends forward curving upwardly to its forward end terminating at a position for attachment to the prow eye or towing eye of the boat. A generally semicircular handle or loop 34 for manipulating and towing the dolly is secured adjacent the forward end of the frame member 32. A pivotally mounted attaching bracket 36 is pivotally mounted to the outer forward end of the frame member 32 and includes an elongated slot 38 for adjustable attachment by a bolt and nut directly to the frame member 32 for adjusting to positions for positioning a bore 40 into position for receiving the prow eye pin for attachment to the prow eye of a boat.

The horizontal support frame portion of the dolly is positioned by the length and curvature of the central support member or frame member 32 such that it fits beneath, slightly aft of, the bow of the boat for full support of the boat vertically directly on the dolly member directly above the caster wheels 20 and 22.

A V-support bracket 42 includes a vertical adjustment bracket 44 for adjustably securing directly to the side of the central frame member 32. This permits the support bracket member 42 to be adjusted vertically for selectively positioning the V-bottom of a boat in height relative to the support dolly. A second V-shaped bow engaging bracket 46 is adjustably mounted by means of a bracket arm 48 to the central frame member 32 at a position approximate the middle thereof between the ends. This positions the bracket 46 so as to engage the lower portion of the bow of the boat by adjustment of the bracket relative thereto.

This adjustable arrangement provides a somewhat universal adjustable dolly arrangement permitting the dolly to fit substantially any boat regardless of depth, curvature or configuration of the bow of the boat. These brackets can be adjusted to position the entire dolly further beneath the boat aft of the bow as necessary to fit the particular boat to be handled.

Figure 2:
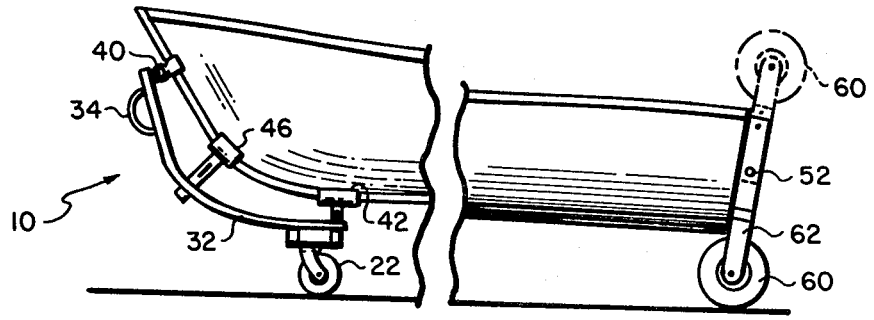
FIG. 2 is side elevation view showing the dolly of FIG. 1 in position on a boat.

The laterally-spaced wheels are preferably spaced on the order of about 18 to 24 inches to provide lateral stability to the boat to prevent tipping of the boat. The steerability of the dolly enhances the utility of the dolly and permits it to be easily and quite conveniently used in conjunction with a stern dolly of either the single wheel or the dual wheel type such as illustrated in FIG. 2. The spaced apart wheels 20 and 22 of the present invention permit it to be used with a single wheel stern dolly and maintain support and stability. Such stern dollies as that illustrated are available on the market, are in common use today, and do not form a part of the present invention. However, such dollies typically include a support bracket 50 detachably connected to the stern of the boat with downwardly depending pair of wheels (only one of which is shown) at 60 mounted on a wheel support arm 62 that is pivotal to a ground engaging position as illustrated. The wheels 60 may be pivoted upward to a retracted position as shown in phantom in FIG. 2 when the boat is afloat in a body of water.

The dolly of the present invention is quickly and easily detachably mounted on a boat or removed therefrom when desired. In attachment to a boat, the dolly is simply positioned under the bow of the boat with the brackets 46 and 42 positioned to provide a total support beneath the boat with the bracket 36 adjusted for alignment with and to be pinned to the prow eye of the boat. Thus, the dolly may be quickly attached to a boat for removing it from the water and towing it on a parking lot or any suitable support surface to a position to be placed on a car top or other suitable hauling conveyance.

In preparation for launching a boat which has been hauled to a body water atop a car, the rear dolly is positioned to support the stern of the boat while the front dolly of the present invention is simply slipped beneath the bow of the upright boat and pinned into place. The boat may then be towed by hand to the water's edge and backed into the water until supported by the water. The front dolly may then be removed simply by removing the bow pin 64 and the dolly then placed inside the boat or returned to the vehicle or other suitable location. The stern dolly wheels may then be retracted to the vertical position and the boat used in its usual manner.

In preparation for removing the boat from the water, the front dolly is simply rolled into the water beneath the bow of the boat with the support brackets 42 and 46 engaging the center of the boat and the prow pin 64 place in position pinning the bracket 36 directly to the prow eye of the boat. The boat may then be easily towed from the water by grasping the towing eye or handle 34 and pulling the boat from the water. The steerable wheels of the dolly permit the boat to be easily steered and towed into a position to be placed on a vehicle or into a storage area as desired.

While we have illustrated and described our invention by means of specific embodiments, it is to be understood that numerous changes and modifications may be made therein without departing from the spirit and scope of the invention as defined in the appended claims.

We claim:

1. A steerable dolly for supporting the bow of a boat for transport over a surface comprising:

an elongated rectangular horizontally extending support frame;

a pair of laterally spaced caster wheels secured beneath opposite ends of said frame;

a V-shaped bow support bracket mounted centrally of said frame for engaging the V-shaped bow of a boat for support of same;

an elongated central forwardly extending frame member having an inner end and an outer end and secured at the inner end to said support frame, and an attachment bracket mounted at the outer end of said central frame member for pinned attachment to a prow eye.

2. The dolly of claim 1 wherein said bow support bracket is vertically adjustable relative to said support frame.

3. The dolly of claim 2 wherein said forwardly extending frame member is curved to the general configuration of the elevational profile of the bow of a boat, and an intermediate support bracket mounted on said forwardly extending frame member intermediate the ends thereof for engaging a front portion of the bow of a boat.

4. The steerable dolly of claim 3 wherein said support frame comprises a pair of spaced apart parallel bars secured together at opposite ends by means of a mounting bracket of said caster wheels.

5. The steerable dolly of claim 4 wherein said bow support bracket and said intermediate support bracket are each independently adjustable.

6. The steerable dolly of claim 5 wherein said attachment bracket is adjustable relative to the outer end of said central frame member.

7. The steerable dolly of claim 3 wherein said horizontal support frame comprises a pair of elongated spaced apart parallel tubular members secured together at the ends thereof by a pair of rectangular caster support plates on which said caster wheels are mounted.

8. A steerable dolly for supporting the bow of a boat for transport over a surface, comprising:

an elongated rectangular horizontally extending support frame comprising a pair of elongated spaced apart parallel tubular members secured together at the ends thereof by a pair of rectangular caster support plates for mounting a pair of caster wheels;

a pair of laterally spaced caster wheels secured to said caster support plates beneath opposite ends of said frame;

a vertically adjustable V-shaped bow support bracket mounted centrally of said frame for engaging the V-shaped bow of a boat for support of same;

an elongated central forwardly extending frame member having an inner end and an outer end and secured at the inner end to said support frame, and said forwardly extending frame member is curved to the general configuration of the elevational profile of the bow of a boat;

an adjustable intermediate support bracket mounted on said forwardly extending frame member intermediate the ends thereof for engaging a front portion of the bow of a boat; and an adjustable attachment bracket mounted at the outer end of said central frame member for pinned attachment to a prow eye.

* * * * *